US008622327B2

(12) United States Patent
Evans

(10) Patent No.: US 8,622,327 B2
(45) **Date of Patent: *Jan. 7, 2014**

(54) LOOSEFILL BLOWING MACHINE HAVING OFFSET GUIDE SHELLS AND VERTICAL FEED

(75) Inventor: Michael E. Evans, Granville, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 554 days.

This patent is subject to a terminal disclaimer.

(21) Appl. No.: 12/727,846

(22) Filed: Mar. 19, 2010

(65) Prior Publication Data

US 2011/0226814 A1 Sep. 22, 2011

(51) Int. Cl.
*B02C 23/20* (2006.01)

(52) U.S. Cl.
USPC ..... 241/60; 241/605

(58) Field of Classification Search
USPC ..... 241/60, 165.5, 605
See application file for complete search history.

(56) References Cited

U.S. PATENT DOCUMENTS 4,111,493 A 9/1978 Sperber
4,465,239 A 8/1984 Woten
5,462,238 A 10/1995 Smith et al.
6,109,488 A * 8/2000 Horton ..... 222/636
2009/0257833 A1 10/2009 Johnson et al.

FOREIGN PATENT DOCUMENTS

| | | |
|---|---|---|
| CA | 2571819 | 6/2007 |
| DE | 2009005452 | 9/2009 |
| GB | 2099776 | 12/1982 |
| GB | 2124194 A | 2/1984 |

* cited by examiner

*Primary Examiner* — Faye Francis
(74) *Attorney, Agent, or Firm* — Fraser Clemens Martin & Miller LLC; Charles F. Charpie

(57) ABSTRACT

A machine for distributing loosefill insulation is provided. The machine includes a chute having an inlet end configured to receive the loosefill insulation. A lower unit is associated with the chute and includes a shredder configured to shred the loosefill insulation and an agitator configured to finely condition the loosefill insulation. The lower unit includes a shredder guide shell positioned partially around the shredder and an agitator guide shell positioned partially around the agitator. A discharge mechanism is positioned in the lower unit. The discharge mechanism has a top inlet positioned below the agitator such that loosefill insulation exiting the agitator is allowed to fall in a substantially vertical direction from the agitator into the top inlet of the discharge mechanism. The position of the shredder guide shell at a passageway is offset in a vertical direction from the position of the agitator guide shell at the passageway.

20 Claims, 6 Drawing Sheets

LOOSEFILL BLOWING MACHINE HAVING OFFSET GUIDE SHELLS AND VERTICAL FEED

BACKGROUND

In the insulation of buildings, a frequently used insulation product is loosefill insulation. In contrast to the unitary or monolithic structure of insulation batts or blankets, loosefill insulation is a multiplicity of discrete, individual tufts, cubes, flakes or nodules. Loosefill insulation is usually applied to buildings by blowing the loosefill insulation into an insulation cavity, such as a wall cavity or an attic of a building. Typically, loosefill insulation is made of glass fibers although other mineral fibers, organic fibers, and cellulose fibers can be used.

Loosefill insulation, also referred to as blowing wool, is typically compressed and encapsulated in a bag. The compressed loosefill insulation and the bag form a package. Packages of compressed loosefill insulation are used for transport from an insulation manufacturing site to a building that is to be insulated. The bags can be made of polypropylene or other suitable materials. During the packaging of the loosefill insulation, it is placed under compression for storage and transportation efficiencies. The compressed loosefill insulation can be packaged with a compression ratio of at least about 10:1. The distribution of loosefill insulation into an insulation cavity typically uses a loosefill blowing machine that feeds the loosefill insulation pneumatically through a distribution hose. Loosefill blowing machines can have a chute or hopper for containing and feeding the compressed loosefill insulation after the package is opened and the compressed loosefill insulation is allowed to expand.

It would be advantageous if the loosefill blowing machines could operate more efficiently.

SUMMARY

The above objects as well as other objects not specifically enumerated are achieved by a machine for distributing loosefill insulation. The machine includes a chute having an inlet end. The inlet end is configured to receive the loosefill insulation. A lower unit is associated with the chute. The lower unit includes a shredder configured to shred and pick apart the loosefill insulation and an agitator configured to finely condition the loosefill insulation. The lower unit further includes a shredder guide shell positioned partially around the shredder and an agitator guide shell positioned partially around the agitator. A discharge mechanism is positioned in the lower unit. The discharge mechanism is configured to discharge loosefill insulation from an outlet of the lower unit. The discharge mechanism has a top inlet. The top inlet is positioned below the agitator such that loosefill insulation exiting the agitator is allowed to fall in a substantially vertical direction from the agitator into the top inlet of the discharge mechanism. The position of the shredder guide shell at a passageway is offset in a vertical direction from the position of the agitator guide shell at the passageway.

According to this invention there are also provided a machine for distributing loosefill insulation. The machine includes a chute having an inlet end. The inlet end is configured to receive the loosefill insulation. A lower unit is associated with the chute. The lower unit includes a shredder configured to shred and pick apart the loosefill insulation and an agitator configured to finely condition the loosefill insulation. The lower unit further includes a shredder guide shell positioned partially around the shredder and an agitator guide shell positioned partially around the agitator. A discharge mechanism is positioned in the lower unit. The discharge mechanism is configured to discharge loosefill insulation from an outlet of the lower unit. The discharge mechanism has a top inlet. The top inlet is positioned below the agitator such that loosefill insulation exiting the agitator is directed by the agitator against a segment of a passageway positioned in the lower unit. The segment is configured to stop movement of the loosefill insulation such that the loosefill insulation falls in a substantially vertical direction into the top inlet of the discharge mechanism. The position of the shredder guide shell at the passageway is offset in a vertical direction from the position of the agitator guide shell at the passageway.

According to this invention there are also provided a machine for distributing loosefill insulation. The machine includes a chute having an inlet end configured to receive the loosefill insulation. A lower unit is associated with the chute. The lower unit includes a first shredder, a second shredder and an agitator. The first and second shredders are configured to shred and pick apart the loosefill insulation. The agitator is configured to finely condition the loosefill insulation. The lower unit further includes a first shredder guide shell positioned partially around the first shredder, a second shredder guide shell positioned around the second shredder and an agitator guide shell positioned partially around the agitator. A discharge mechanism is positioned in the lower unit and is configured to discharge loosefill insulation from an outlet of the lower unit. The discharge mechanism has a top inlet positioned adjacent the agitator such that loosefill insulation exiting the agitator is allowed to fall in a substantially vertical direction into the top inlet of the discharge mechanism. A second end of the first shredder guide shell is offset in a vertical direction from the second end of the second shredder guide shell. The second end of the second shredder guide shell is offset in a vertical direction from a second end of the agitator guide shell.

Various objects and advantages of this invention will become apparent to those skilled in the art from the following detailed description of the preferred embodiment, when read in light of the accompanying drawings.

DETAILED DESCRIPTION OF THE INVENTION

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

In accordance with embodiments of the present invention, the description and figures disclose loosefill blowing machines having offset guide shells and a vertical feed. The term "loosefill insulation", as used herein, is defined to include any insulation materials configured for distribution in an airstream. The term "finely condition", as used herein, is defined to mean the shredding of loosefill insulation to a desired density prior to distribution in an airstream.

Figure 1:
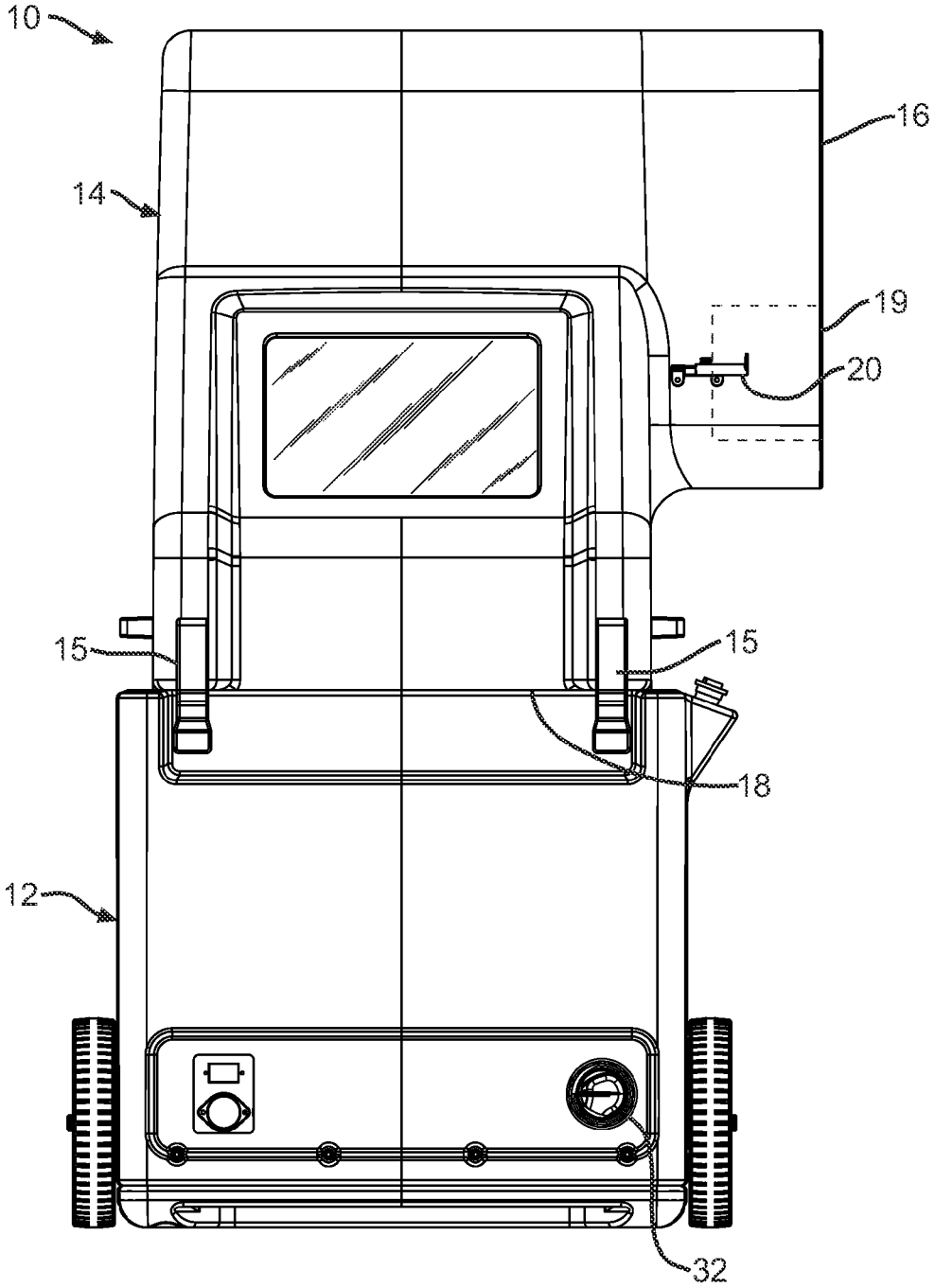
FIG. 1 is a front view in elevation of a blowing insulation machine.
Figure 2:
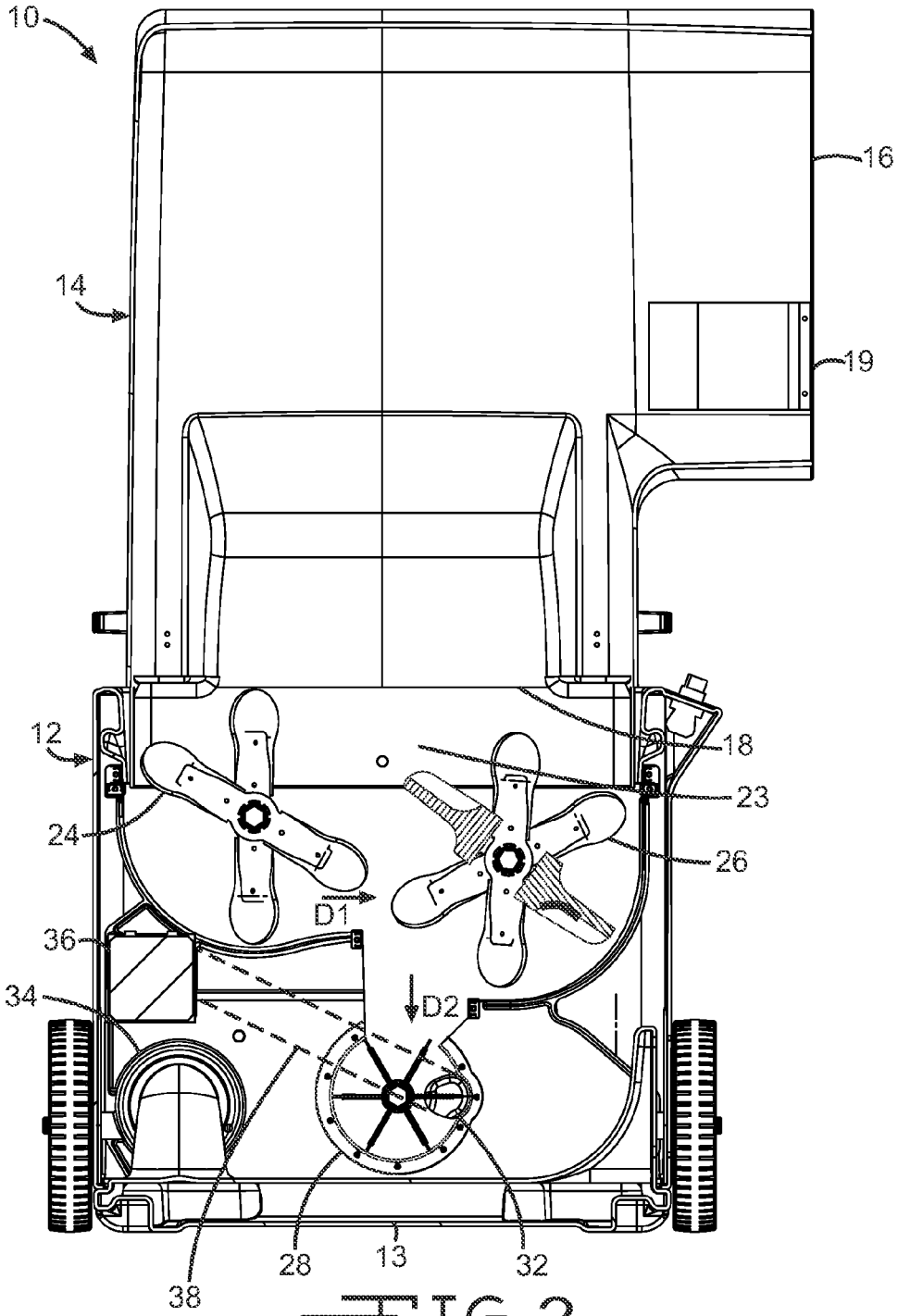
FIG. 2 is a front view, partially in cross-section, of the blowing insulation machine of FIG. 1.
Figure 3:
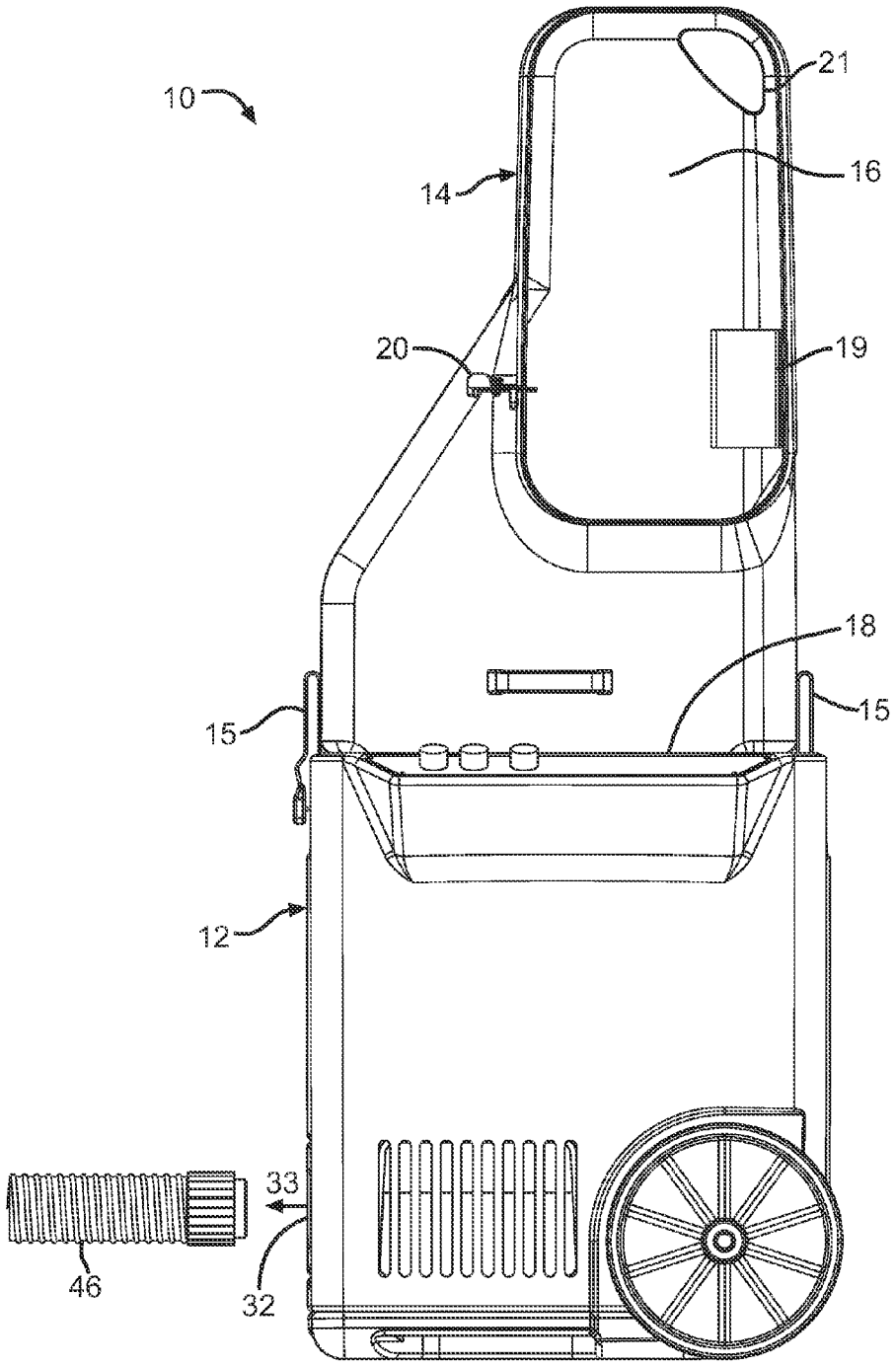
FIG. 3 is a side view in elevation of the blowing insulation machine of FIG. 1.

A loosefill blowing machine 10 configured for distributing compressed loosefill insulation is shown in FIGS. 1-3. The loosefill blowing machine 10 includes a lower unit 12 and a chute 14. The lower unit 12 can be connected to the chute 14 by a plurality of fastening mechanisms 15 configured to readily assemble and disassemble the chute 14 to the lower unit 12. As further shown in FIGS. 1-3, the chute 14 has an inlet end 16 and an outlet end 18.

The chute 14 is configured to receive compressed loosefill insulation and introduce the loosefill insulation to a shredding chamber 23 as shown in FIG. 2. Optionally, the chute 14 can include a handle segment 21, as shown in FIG. 3, to facilitate easy movement of the loosefill blowing machine 10 from one location to another. However, the handle segment 21 is not necessary to the operation of the loosefill blowing machine 10.

As further shown in FIGS. 1-3, the chute 14 can include an optional guide assembly 19 mounted at the inlet end 16 of the chute 14. The guide assembly 19 is configured to urge a package of compressed loosefill insulation against an optional cutting mechanism 20, as shown in FIGS. 1 and 3, as the package of compressed loosefill insulation moves into the chute 14.

As shown in FIG. 2, the shredding chamber 23 is mounted at the outlet end 18 of the chute 14. In the illustrated embodiment, the shredding chamber 23 includes a low speed shredder 24 and an agitator 26. The low speed shredder 24 is configured to shred and pick apart the loosefill insulation as the loosefill insulation is discharged from the outlet end 18 of the chute 14 into the lower unit 12. Although the loosefill blowing machine 10 is shown with a single low speed shredder 24, any quantity of low speed shredder or any type of separator, such as a clump breaker, beater bar or any other mechanism that shreds and picks apart the loosefill insulation can be used.

As further shown in FIG. 2, the shredding chamber 23 includes an agitator 26 configured to finely condition the loosefill insulation. In the embodiment illustrated in FIG. 2, the agitator 26 is positioned substantially horizontally adjacent the low speed shredder 24. The term "substantially horizontally adjacent", as used herein, is defined to mean that the low speed shredder 24 and the agitator 26 as substantially in a same horizontal plane. Alternatively, the agitator 26 can be positioned in any desired location relative to the low speed shredder 24, such as the non-limiting example of vertically adjacent to the low speed shredder 24, sufficient to receive the loosefill insulation from the low speed shredder 24. In the illustrated embodiment, the agitator 26 is a high speed shredder. Alternatively, any type of agitator or shredder can be used, such as a clump breaker, beater bar or any other mechanism configured to finely condition the loosefill insulation and prepare the loosefill insulation for distribution in an airstream.

In the embodiment illustrated in FIG. 2, the low speed shredder 24 rotates at a lower speed than the agitator 26. The low speed shredder 24 rotates at a speed of about 40-80 rpm and the agitator 26 rotates at a speed of about 300-500 rpm. In other embodiments, the low speed shredder 24 can rotate at a speed less than or more than 40-80 rpm, provided the speed is sufficient to shred and pick apart the loosefill insulation. The agitator 26 can rotate at a speed less than or more than 300-500 rpm provided the speed is sufficient to finely condition the loosefill insulation and prepare the loosefill insulation for distribution in an airstream.

Referring again to FIG. 2, a discharge mechanism 28 is positioned in a direction vertically below the low speed shredder 24 and the agitator 26. The discharge mechanism 28 is configured to distribute the finely conditioned loosefill insulation into an airstream. In the illustrated embodiment, the discharge mechanism 28 is a rotary valve. Alternatively, the discharge mechanism 28 can be any mechanism including staging hoppers, metering devices, or rotary feeders, sufficient to distribute the finely conditioned loosefill insulation into an airstream.

In the illustrated embodiment as shown in FIG. 2, the finely conditioned loosefill insulation is driven through the discharge mechanism 28 and through a machine outlet 32 by an airstream provided by a blower 36 mounted in the lower unit 12. The airstream is indicated by an arrow 33 as shown in FIG. 3. In other embodiments, the airstream 33 can be provided by other methods, such as by a vacuum, sufficient to provide an airstream 33 driven through the discharge mechanism 28. In the illustrated embodiment, the blower 36 provides the airstream 33 to the discharge mechanism 28 through a duct 38, shown in phantom in FIG. 2, extending from the blower 36 to the rotary valve 28. Alternatively, the airstream 33 can be provided to the discharge mechanism 28 by other structures, such as a hose or pipe, sufficient to provide the discharge mechanism 28 with the airstream 33.

The low speed shredder 24, agitator 26, discharge mechanism 28 and the blower 36 are mounted for rotation. They can be driven by any suitable means, such as by a motor 34, or any other means sufficient to drive rotary equipment. Alternatively, the shredder 24, agitator 26, discharge mechanism 28 and blower 36 can be provided with its own motor.

Generally, in operation, the chute 14 guides the loosefill insulation to the shredding chamber 23. The shredding chamber 23 includes the low speed shredder 24 and the agitator 26. The low speed shredder 24 is configured to shred and pick apart the loosefill insulation. The shredded loosefill insulation exits the low speed shredder 24 in the direction D1 and enters the agitator 26. The agitator 26 is configured to finely condition the loosefill insulation for distribution into the airstream 33 by further shredding the loosefill insulation. The finely conditioned loosefill insulation exits the agitator 26 and falls in direction D2 into the discharge mechanism 28 for distribution into the airstream 33 caused by the blower 36. The airstream 33, with the finely conditioned loosefill insulation, exits the machine 10 at the machine outlet 32 and flows through a distribution hose 46, as shown in FIG. 3, toward the insulation cavity, not shown.

Figure 4:
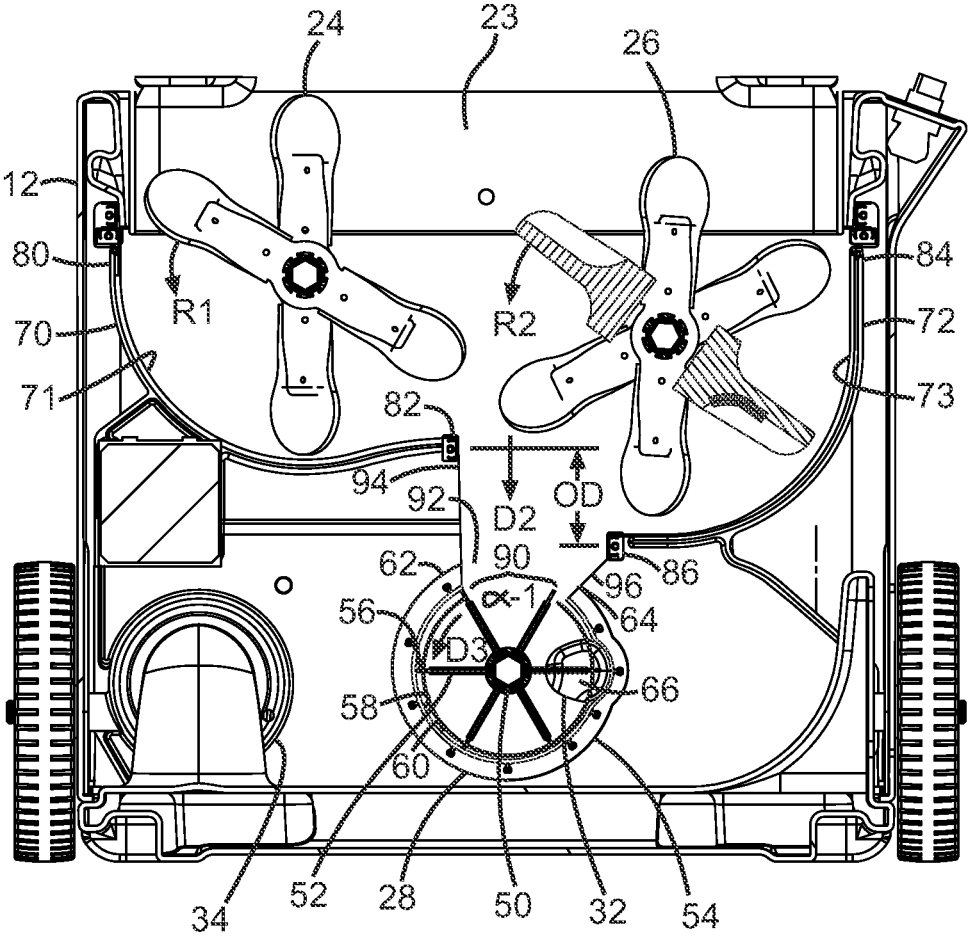
FIG. 4 is a front view, partially in cross-section, of a first embodiment of a lower unit of the blowing insulation machine of FIG. 1.

Referring now to FIG. 4, the low speed shredder 24 rotates in a counter-clockwise direction R1 and the agitator 26 rotates in a counter-clockwise direction R2. Rotating the low speed shredder 24 and the agitator 26 in the same counter-clockwise directions, R1 and R2, allows the low speed shredder 24 and the agitator 26 to shred and pick apart the loosefill insulation while substantially preventing an accumulation of unshredded or partially shredded loosefill insulation in the shredding chamber 23. In other embodiments, the low speed shredder 24 and the agitator 26 could rotate in a clock-wise direction or the low speed shredder 24 and the agitator 26 could rotate in different directions provided the relative rotational directions allow finely conditioned loosefill insulation to be fed into the discharge mechanism 28 while preventing a substantial accumulation of unshredded or partially shredded loosefill insulation in the shredding chamber 23.

As further shown FIG. 4, the shredding chamber 23 includes a shredder guide shell 70 and an agitator guide shell 72. Shredder guide shell 70 is positioned partially around the low speed shredder 24 and extends to form an arc of approximately 90°. Shredder guide shell 70 has an inner surface 71. Shredder guide shell 70 is configured to allow the low speed shredder 24 to seal against the inner surface 71 of the shredder guide shell 70 and thereby direct the loosefill insulation in a direction toward the agitator 26 as the low speed shredder 24 rotates in direction R1.

In a manner similar to the shredder guide shell 70, the agitator guide shell 72 is positioned partially around the agitator 26 and extends to form an arc of approximate 90°. Agitator guide shell 72 has an inner surface 73. Agitator guide shell 72 is configured to allow the agitator 26 to seal against the inner surface 73 and thereby direct the loosefill insulation in a downstream direction as the agitator 26 rotates in direction R2.

In the embodiment illustrated in FIG. 4, the shredder inner surface 71 and the agitator inner surface 73 are made of high density polyethylene (hdpe) configured to provide a lightweight, low friction guide for the loosefill insulation. Alternatively, the inner surfaces, 71 and 73, can be made of other materials, such as aluminum, sufficient to provide a sealing surface that allows the low speed shredder 24 and the agitator 26 to direct the loosefill insulation in a downstream direction.

Referring again to FIG. 4, the shredder guide shell 70 has a first end 80 and a second end 82. Similarly, the agitator guide shell 72 has a first end 84 and a second end 86. As illustrated in FIG. 4, the second end 82 of the shredder guide shell 70 is offset in a vertical direction from the second end 86 of the agitator guide shell 72 by an offset distance OD. The term "offset", as used herein, is defined to mean vertical displacement. In the illustrated embodiment, the offset distance OD is in a range of from about 1.0 inch to about 8.0 inches. In other embodiments, the offset distance OD can be less than about 1.0 inch or more than about 8.0 inches.

The arrangement of the shredder guide shell 70 and the agitator guide shell 72 in an offset manner can provide significant benefits over arrangements of shredder guide shells and agitator guide shells that may be on a substantially similar horizontal plane. However, not all of the benefits may be realized in all situations and in all embodiments. First, the offset between the shredder guide shell 70 and the agitator guide shell 72 provides that the loosefill insulation is conditioned to a desired level at the shredder 24 prior to the loosefill insulation exiting the shredder 24 and entering the agitator 26. While the loosefill insulation is at the low speed shredder 24, the shredder guide shell 70 is configured to retain the loosefill insulation until the desired shredding is achieved prior to pushing the shredded loosefill insulation to the agitator 26. This results in loosefill insulation having a desired level of shredding prior to entering the agitator 26. Second, the offset between the shredder guide shell 70 and the agitator guide shell 72 provides for increased protection against jamming by large tufts of unshredded or improperly shredded loosefill insulation. Lastly, the offset between the shredder guide shell 70 and the agitator guide shell 72 provides for increased protection against an over-amperage surge to the motor 34 as a result of clogging or jamming of large tufts of unshredded or improperly shredded loosefill insulation.

Referring again to FIG. 4, the discharge mechanism 28 includes a valve shaft 50 mounted for rotation within the discharge mechanism 28, a plurality of seal assemblies 52 mounted to and supported by the valve shaft 50, and a valve housing 54. Generally, the seal assemblies 52 are configured to seal against the valve housing 54 as the valve shaft 50 rotates within the valve housing 54. In the illustrated embodiment, the valve shaft 50 is made of steel, although the valve shaft 50 can be made of other desired materials, such as aluminum or plastic. In the illustrated embodiment, the seal assemblies 52 include a plurality of vanes extending radially from the valve shaft 50, each of the vanes having a seal tip 56 configured to seal against the valve housing 54 as the valve shaft 50 rotates within the valve housing 54. In other embodiments, the seal assemblies 52 can have any desired structure sufficient to seal against the valve housing 54 as the valve shaft 50 rotates within the valve housing 54. While the embodiment illustrated in FIG. 4 shows a quantity of six seal assemblies 52, it should be appreciated that in other embodiments any desired quantity of seal assemblies 52 can be used.

Referring again to FIG. 4, the valve shaft 50, having the seal assemblies 52 assembled on the valve shaft 50, rotates within the valve housing 54 in a counter-clock wise direction as indicated by the arrow D3. Alternatively, the valve shaft 50 can be configured to rotate in a clockwise direction.

In the embodiment illustrated in FIG. 4, the valve housing 54 is made from an aluminum extrusion, although in other embodiments the valve housing 54 can be made from other desired materials, including brass or plastic, sufficient to form a housing within which the valve shaft 50 rotates. In the illustrated embodiment as shown in FIG. 4, the valve housing 54 is made of a single segment. Alternatively, the valve housing 54 can be made of two or more associated segments.

As shown in FIG. 4, the valve housing 54 includes an inner housing wall 58. The inner housing wall 58 has an inner housing surface 60. Optionally, the inner housing surface 60 can have a coating to provide a low friction and extended wear surface. One example of a low friction coating is a chromium alloy although other materials may be used. Alternatively, the inner housing surface 60 may not be coated with a low friction and extended wear surface.

As shown in FIG. 4, the valve housing 54 is curved and extends to form a segment having a generally circular shape. The valve housing 54 has a first end 62 and a second end 64. A valve housing wrap angle $\alpha$-1 extends from the first end 62 of the valve housing 54 to the second end 64 of the valve housing 54. In the illustrated embodiment, the valve housing wrap angle $\alpha$-1 is in a range of from about 265° to about 300°.

Alternatively, the valve housing 54 can form other circular segments having other desired valve housing wrap angles α-1.

As shown in FIG. 4, the valve housing 54 includes an eccentric region 66. The eccentric region 66 extends from or bulges out from a portion of the valve housing 54. The eccentric region 66 can have any desired cross-sectional shape. The eccentric region 66 is within the airstream 33 flowing through the discharge mechanism 28. In operation, as the seal assemblies 52 rotate into the airstream 33, the airstream 33 flows along the seal tip 56, thereby forcing any particles of loosefill insulation caught on the seal tip 56 to be blown off and assisting in preventing a buildup of finely conditioned loosefill insulation from forming within the discharge mechanisms 28. While the embodiment illustrated in FIG. 4 illustrates the eccentric region 66 as being positioned in a right quadrant of the discharge mechanism 28, it should be appreciated that the eccentric region 66 can be positioned in any suitable location within the discharge mechanism 28.

Referring again to FIG. 4, the valve housing 54 forms a top inlet 90. The top inlet 90 is configured to receive the finely conditioned loosefill insulation as it is falls from the agitator 26. The term "top inlet", as used herein, is defined to mean an inlet that is positioned above a horizontal axis extending through the center of the valve shaft 50. Positioning the top inlet 90 of the discharge mechanism 28 at the top of the discharge mechanism 28 allows finely conditioned loosefill insulation to fall in a substantially vertical direction D2, from the agitator 26 into the discharge mechanism 28. In the illustrated embodiment, the finely conditioned loosefill insulation falls in the substantially vertical direction D2 as a result of the force of gravity. In other embodiments, the finely conditioned loosefill insulation falls in the substantially vertical direction D2 as a result an urging from the agitator 26. The term "substantially vertical direction", as used herein, is defined to mean feeding of the finely conditioned loosefill insulation from the agitator 26 to the discharge mechanism 28 in a direction that is +/−30° to a vertical axis extending through the valve shaft 50. Feeding finely conditioned loosefill insulation in a substantially vertical direction D2 into the discharge mechanism 28 advantageously provides for a smooth flow of the finely conditioned loosefill insulation through the shredding chamber 23 and into the discharge mechanism 28 and substantially prevents the undesired build-up of accumulated loosefill insulation.

As further shown in FIG. 4, a passageway 92 is formed between the shredder 24 and the agitator 26 and the discharge mechanism 28. The passageway 92 is configured to channel the finely conditioned loosefill insulation exiting the agitator 26 and flowing into the discharge mechanism 28. The passageway 92 includes a first segment 94 extending from the second end 82 of the shredder guide shell 70 to the first end 62 of the valve housing 54 and a second segment 96 extending from the second end 86 of the agitator guide shell 72 to the second end 64 of the valve housing 54. In the illustrated embodiment, the first and second segments, 94 and 96, of the passageway 92 are made of high density polyethylene (hdpe) configured to provide a lightweight, low friction guide for the finely conditioned loosefill insulation. Alternatively, the first and second segments, 94 and 96, can be made of other desired materials.

Figure 5:
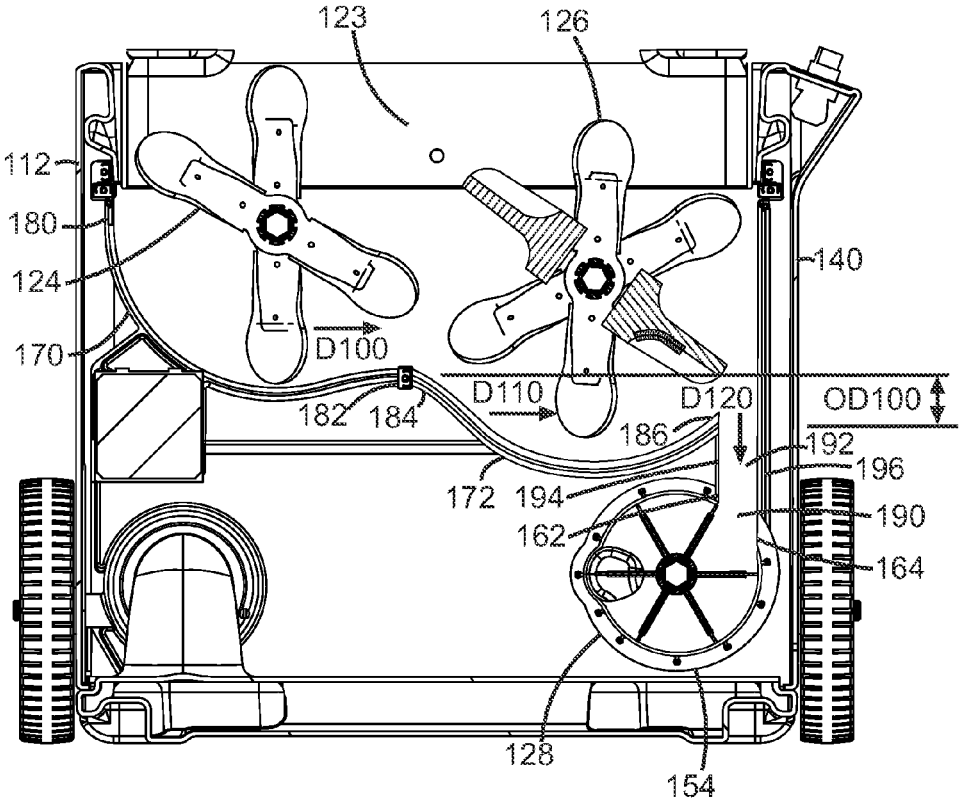
FIG. 5 is a front view, partially in cross-section, of a second embodiment of a lower unit of the blowing insulation machine of FIG. 1.

Referring now to FIG. 5, another embodiment of a lower unit 112 of a loosefill blowing machine is illustrated. The lower unit 112 includes a low speed shredder 124, an agitator 126 and a discharge mechanism 128. In the illustrated embodiment, the low speed shredder 124, agitator 126 and discharge mechanism 128 are the same as, or similar to, the low speed shredder 24, agitator 26 and discharge mechanism 28 described above and illustrated in FIG. 4. Alternatively, the low speed shredder 124, agitator 126 and discharge mechanism 128 can be different from the low speed shredder 24, agitator 26 and discharge mechanism 28.

Referring again to FIG. 5, the lower unit 112 also includes a shredder guide shell 170 positioned partially around the low speed shredder 124 and an agitator guide shell 172 positioned partially around the agitator 126. In the illustrated embodiment, the shredder guide shell 170 and the agitator guide shell 172 are the same as, or similar to, the shredder guide shell 70 and the agitator guide shell 72 discussed above and illustrated in FIG. 4. In other embodiments, the shredder guide shell 170 and the agitator guide shell 172 can be different from the shredder guide shell 70 and the agitator guide shell 72.

As shown in FIG. 5, the shredder guide shell 170 has a first end 180 and a second end 182. Similarly, the agitator guide shell 172 has a first end 184 and a second end 186. As illustrated in FIG. 5, the second end 182 of the shredder guide shell 170 is offset in a vertical direction from the second end 186 of the agitator guide shell 172 by an offset distance OD100. In the illustrated embodiment, the offset distance OD100 is in a range of from about 1.0 inch to about 8.0 inches. In other embodiments, the offset distance OD100 can be less than about 1.0 inch or more than about 8.0 inches.

While the embodiment illustrated in FIG. 5, shows the second end 182 of the shredder guide shell 170 substantially coinciding with the first end 184 of the agitator guide shell 172, it should be appreciated that in other embodiments the second end 182 of the shredder guide shell 170 may not substantially coincide with the first end 184 of the agitator guide shell 172.

Referring again to FIG. 5, the discharge mechanism 128 includes a valve housing 154. The valve housing 154 extends to form a top inlet 190. The top inlet 190 is configured to receive finely conditioned loosefill insulation as it is falls from the agitator 126.

As further shown in FIG. 5, a passageway 192 is formed between the agitator 126 and the discharge mechanism 128. The passageway 192 is configured to channel the finely conditioned loosefill insulation exiting the agitator 126 and flowing into the discharge mechanism 128. The passageway 192 includes a first segment 194 extending from the second end 186 of the agitator guide shell 172 to a first end 162 of the valve housing 154 and a second segment 196 extending vertically upward from the second end 164 of the valve housing 154. In the illustrated embodiment, the first and second segments, 194 and 196, of the passageway 192 are made of high density polyethylene (hdpe) configured to provide a lightweight, low friction guide for the finely conditioned loosefill insulation. Alternatively, the first and second segments, 194 and 196, can be made of other desired materials.

In operation, the low speed shredder 124 shreds and picks apart the loosefill insulation. The shredded loosefill insulation exits the low speed shredder 124 in the direction D100 and enters the agitator 126. The agitator 26 is configured to finely condition the loosefill insulation for distribution into an airstream (not shown) by further shredding the loosefill insulation. The finely conditioned loosefill insulation exits the agitator 126 in direction D110 and contacts the second segment 196 of the passageway 192. Contacting the second segment 196 causes the movement of the finely conditioned loosefill insulation to stop, wherein the finely conditioned loosefill insulation falls, by the force of gravity in direction D120, into the top inlet 190 of the discharge mechanism 28 for distribution into the airstream.

While the embodiment illustrated in FIG. 5 shows the finely conditioned loosefill insulation contacting the second segment 196 of the passageway 192, it should be appreciated that in other embodiments, the finely conditioned loosefill insulation can be directed to contact other structures, including the non-limiting example of a wall 140 of the lower unit 112 for the purpose of stopping the movement of the finely conditioned loosefill insulation. In a similar manner to the structure illustrated in FIG. 4, the combination of the offset guide shells and the vertical feed of the finely conditioned loosefill insulation advantageously provides for a smooth flow of the finely conditioned loosefill insulation through the shredding chamber 123 and into the discharge mechanism 128 and substantially prevents the undesired build-up of accumulated loosefill insulation.

Figure 6:
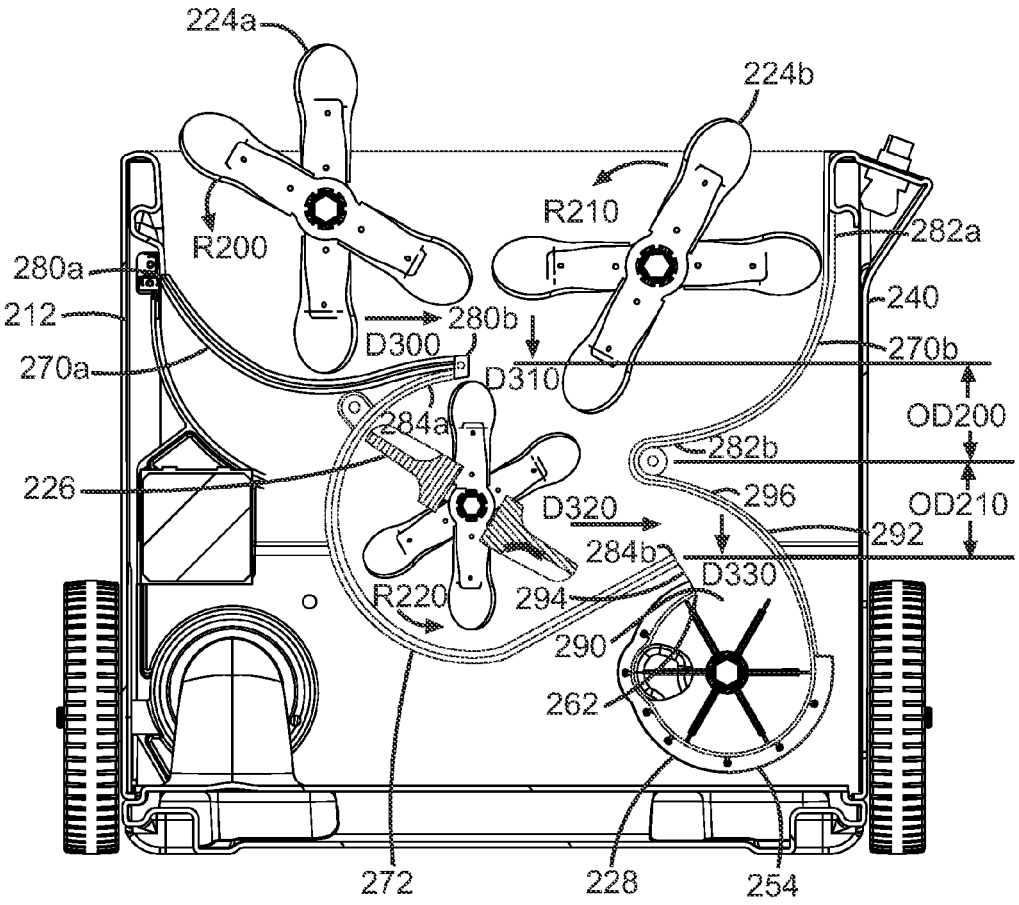
FIG. 6 is a front view, partially in cross-section, of a third embodiment of a lower unit of the blowing insulation machine of FIG. 1.

Referring now to FIG. 6, another embodiment of a lower unit 212 of a loosefill blowing machine is illustrated. The lower unit 212 includes a first low speed shredder 224*a*, a second low speed shredder 224*b*, an agitator 226 and a discharge mechanism 228. In the illustrated embodiment, the first low speed shredder 224*a* and the second low speed shredder 224*b* are the same as, or similar to, the low speed shredder 24 discussed above and shown in FIG. 4. However, in some embodiments the first low speed shredder 224*a* and the second low speed shredder 224*b* can be different from the low speed shredder 24.

Referring again to FIG. 6, the agitator 226 and the discharge mechanism 228 are the same as, or similar to, the agitator 26 and the discharge mechanism 28 described above and illustrated in FIG. 4. Alternatively, the agitator 226 and the discharge mechanism 228 can be different from the agitator 26 and discharge mechanism 28.

As shown in FIG. 6, the lower unit 212 also includes a first shredder guide shell 270*a* positioned partially around the first low speed shredder 224*a*, a second shredder guide shell 270*b* positioned partially around the second low speed shredder 224*b*, and an agitator guide shell 272 positioned partially around the agitator 226. In the illustrated embodiment, the shredder guide shells, 270*a* and 270*b*, and the agitator guide shell 272 are the same as, or similar to, the shredder guide shell 70 and the agitator guide shell 72 discussed above and illustrated in FIG. 4. In other embodiments, the shredder guide shells, 270*a* and 270*b*, and the agitator guide shell 272 can be different from the shredder guide shell 70 and the agitator guide shell 72.

As further shown in FIG. 5, the first shredder guide shell 270*a* has a first end 280*a* and a second end 280*b*. Similarly, the second shredder guide shell 270*b* has a first end 282*a* and a second end 282*b*. The agitator guide shell 272 has a first end 284*a* and a second end 284*b*. As illustrated in FIG. 6, the second end 280*b* of the first shredder guide shell 270*a* is offset in a vertical direction from the second end 282*b* of the second shredder guide shell 282*b* by an offset distance OD200. In the illustrated embodiment, the offset distance OD200 is in a range of from about 1.0 inch to about 8.0 inches. In other embodiments, the offset distance OD200 can be less than about 1.0 inch or more than about 8.0 inches. Similarly, the second end 282*b* of the second shredder guide shell 270*b* is offset in a vertical direction from the second end 284*b* of the agitator guide shell 272 by an offset distance OD210. In the illustrated embodiment, the offset distance OD210 is in a range of from about 1.0 inch to about 8.0 inches. In other embodiments, the offset distance OD210 can be less than about 1.0 inch or more than about 8.0 inches.

While the embodiment illustrated in FIG. 6, shows the second end 280*b* of the first shredder guide shell 270*a* substantially coinciding with the first end 284*a* of the agitator guide shell 272, it should be appreciated that in other embodiments the second end 280*b* of the shredder guide shell 270*a* may not substantially coincide with the first end 284*a* of the agitator guide shell 272.

Referring again to FIG. 6, the discharge mechanism 228 includes a valve housing 254. The valve housing 254 extends to form a top inlet 290. The top inlet 290 is configured to receive the finely conditioned loosefill insulation as it is falls from the agitator 226.

As further shown in FIG. 6, a passageway 292 is formed between the agitator 226 and the discharge mechanism 228. The passageway 292 is configured to channel the finely conditioned loosefill insulation exiting the agitator 226 and falling into the discharge mechanism 228. The passageway 292 includes a first segment 294 extending from the second end 284*b* of the agitator guide shell 272 to a first end 262 of the valve housing 254 and a second segment 296 extending in a downward from the second end 282*b* of the second shredder guide shell 270*b*. In the illustrated embodiment, the first and second segments, 294 and 296, of the passageway 292 are made of high density polyethylene (hdpe) configured to provide a lightweight, low friction guide for the finely conditioned loosefill insulation. Alternatively, the first and second segments, 294 and 296, can be made of other desired materials.

In operation, the first low speed shredder 224*a* rotates in the counter-clockwise direction indicated by the arrow R200. Similarly, the second low speed shredder 224*b* rotates in the counter-clockwise direction indicated by the arrow R210. The first low speed shredder 224*a* is configured to shred and pick apart the loosefill insulation. The shredded loosefill insulation exits the first low speed shredder 224*a* in the direction D300 and enters the second low speed shredder 224*b*. The second low speed shredder 224*b* is configured to shred and pick apart the loosefill insulation. The shredded loosefill insulation exits the second low speed shredder 224*b* in the direction D310 and enters the agitator 226. The agitator 226 rotates in the counter-clockwise direction indicated by the arrow R220. The agitator 226 is configured to finely condition the loosefill insulation for distribution into an airstream (not shown) by further shredding the loosefill insulation. The finely conditioned loosefill insulation exits the agitator 226 in direction D320 and contacts the second segment 296 of the passageway 292. Contacting the second segment 296 causes the movement of the finely conditioned loosefill insulation to be deflected such that the finely conditioned loosefill insulation falls, by the force of gravity in direction D330, into the top inlet 290 of the discharge mechanism 228 for distribution into the airstream.

While the embodiment illustrated in FIG. 6 shows the finely conditioned loosefill insulation contacting the second segment 296 of the passageway 292, it should be appreciated that in other embodiments, the finely conditioned loosefill insulation can be directed to contact other structures, including the non-limiting example of a wall 240 of the lower unit 212 for the purpose of stopping the movement of the finely conditioned loosefill insulation. In a similar manner to the structure illustrated in FIG. 4, the combination of the offset guide shells and the vertical feed of the finely conditioned loosefill insulation advantageously provides for a smooth flow of the finely conditioned loosefill insulation through the shredding chamber and into the discharge mechanism 228 and substantially prevents the undesired build-up of accumulated loosefill insulation.

The principle and mode of operation of this loosefill blowing machine have been described in its preferred embodiments. However, it should be noted that the loosefill blowing machine may be practiced otherwise than as specifically illustrated and described without departing from its scope.

What is claimed is:

1. A machine for distributing loosefill insulation, the machine comprising:

a chute having an inlet end, the inlet end configured to receive the loosefill insulation;

a lower unit associated with the chute, the lower unit including a shredder configured to shred and pick apart the loosefill insulation, the shredder further configured to guide the shredded insulation into an agitator, the shredder and the agitator positioned in substantially the same horizontal plane, the agitator configured to finely condition the loosefill insulation, the lower unit further including a shredder guide shell positioned partially around the shredder and configured to allow the shredder to seal against an inner surface of the shredder guide shell, and an agitator guide shell positioned partially around the agitator and configured to allow the agitator to seal against an inner surface of the agitator guide shell; and a discharge mechanism positioned in the lower unit, the discharge mechanism being configured to discharge loosefill insulation from an outlet of the lower unit, the discharge mechanism having a top inlet, the top inlet positioned below the agitator such that loosefill insulation exiting the agitator is allowed to fall in a substantially vertical direction from the agitator into the top inlet of the discharge mechanism;

wherein a lower end of the shredder guide shell is offset in a vertical direction from a lower end of the agitator guide shell.

2. The machine of claim 1, wherein the loosefill insulation exiting the agitator is allowed to fall by the force of gravity from the agitator into the top inlet of the discharge mechanism.

3. The machine of claim 1, wherein a second end of the shredder guide shell positioned at the passageway is positioned vertically above a second end of the agitator guide shell positioned at the passageway.

4. The machine of claim 3, wherein the offset of the second end of the shredder guide shell from the second end of the agitator is in a range of from about 1.0 inch to about 8.0 inches.

5. The machine of claim 4, wherein a first segment of the passageway extends from second end of the shredder guide shell to the discharge mechanism and a second segment of the passageway extends from the second end of the agitator guide shell to the discharge mechanism.

6. The machine of claim 1, wherein the discharge mechanism includes a valve housing, wherein the valve housing extends in a range of from about 260° to about 300°.

7. The machine of claim 6, wherein the top inlet has an opening in a range of from about 60° to about 100°.

8. The machine of claim 1, wherein the agitator is positioned substantially horizontally adjacent the low speed shredder.

9. A machine for distributing loosefill insulation, the machine comprising:

a chute having an inlet end, the inlet end configured to receive the loosefill insulation;

a lower unit associated with the chute, the lower unit including a shredder configured to shred and pick apart the loosefill insulation, the shredder further configured to guide the shredded insulation into an agitator, the shredder and the agitator positioned in substantially the same horizontal plane, the agitator configured to finely condition the loosefill insulation, the lower unit further including a shredder guide shell positioned partially around the shredder and configured to allow the shredder to seal against an inner surface of the shredder guide shell, and an agitator guide shell positioned partially around the agitator, and configured to allow the agitator to seal against an inner surface of the agitator guide shell; and a discharge mechanism positioned in the lower unit, the discharge mechanism being configured to discharge loosefill insulation from an outlet of the lower unit, the discharge mechanism having a top inlet, the top inlet positioned below the agitator such that loosefill insulation exiting the agitator is directed by the agitator against a segment of a passageway positioned in the lower unit, the segment configured to stop movement of the loosefill insulation such that the loosefill insulation falls in a substantially vertical direction into the top inlet of the discharge mechanism;

wherein a lower end of the shredder guide shell is offset in a vertical direction from a lower end of the agitator guide shell.

10. The machine of claim 9, wherein the segment extends upward from the top inlet of the discharge mechanism.

11. The machine of claim 9, wherein the segment is a wall of the lower unit.

12. The machine of claim 9, wherein the loosefill insulation exiting the agitator is allowed to fall by the force of gravity from the segment into the top inlet of the discharge mechanism.

13. The machine of claim 9, wherein a second end of the shredder guide shell positioned at the passageway is positioned vertically above a second end of the agitator guide shell positioned at the passageway.

14. The machine of claim 13, wherein the offset of the second end of the shredder guide shell from the second end of the agitator is in a range of from about 1.0 inch to about 8.0 inches.

15. The machine of claim 9, wherein the agitator is positioned substantially horizontally adjacent the shredder.

16. The machine of claim 13, wherein the second end of the shredder guide shell and the first end of the agitator guide shell substantially coincide.

17. The machine of claim 9, wherein the shredder and the agitator rotate in the same direction.

18. A machine for distributing loosefill insulation, the machine comprising:

a chute having an inlet end, the inlet end configured to receive the loosefill insulation;

a lower unit associated with the chute, the lower unit including a first shredder, a second shredder and an agitator, the first and second shredders configured to shred and pick apart the loosefill insulation, the first shredder configured to guide the shredded insulation into the second shredder, the first and second shredders positioned in substantially the same horizontal plane, the agitator configured to finely condition the loosefill insulation, the lower unit further including a first shredder guide shell positioned partially around the first shredder and configured to allow the first shredder to seal against an inner surface of the first shredder guide shell, a second shredder guide shell positioned around the second shredder and configured to allow the second shredder to seal against an inner surface of the second shredder guide shell, and an agitator guide shell positioned partially around the agitator and configured to allow the agitator to seal against an inner surface of the agitator guide shell; and a discharge mechanism positioned in the lower unit, the discharge mechanism being configured to discharge loosefill insulation from an outlet of the lower unit, the discharge mechanism having a top inlet, the top inlet positioned adjacent the agitator such that loosefill insulation exiting the agitator is allowed to fall in a substantially vertical direction into the top inlet of the discharge mechanism;

wherein a second end of the first shredder guide shell is offset in a vertical direction from a second end of the second shredder guide shell;

wherein the second end of the second shredder guide shell is offset in a vertical direction from a second end of the agitator guide shell.

19. The machine of claim 18, wherein the second end of the first shredder guide shell is positioned vertically above the second end of the shredder guide shell and the second end of the second shredder guide shell is positioned vertically above the second end of the agitator guide shell.

20. The machine of claim 19, wherein the offset between the second end of the first shredder guide shell and the second end of the second shredder guide shell is in a range of from about 1.0 inch to about 8.0 inches, and the offset between the second end of the second shredder guide shell and the second end of the agitator guide shell is in a range of from about 1.0 inch to about 8.0 inches.

* * * * *